United States Patent [19]

Schauman

[11] 4,098,173

[45] Jul. 4, 1978

[54] AUTOMATIC COMPENSATING REGISTER

[75] Inventor: James L. Schauman, Jamestown, N.Y.

[73] Assignee: Jamestown Container Corporation, Jamestown, N.Y.

[21] Appl. No.: 789,851

[22] Filed: Apr. 22, 1977

[51] Int. Cl.[2] ..... B31B 1/14

[52] U.S. Cl. ..... 93/58.2 R; 83/324

[58] Field of Search ..... 83/324, 593; 93/58.2 R; 74/393; 192/127; 271/202, 203, 270

[56] References Cited

U.S. PATENT DOCUMENTS

| | | | |
|---|---|---|---|
| 3,156,150 | 11/1964 | Sarka | 83/324 X |
| 3,742,798 | 7/1973 | Gries | 83/324 X |
| 3,745,865 | 7/1973 | Johnson | 83/324 X |
| 3,952,637 | 4/1976 | Lambert et al. | 93/58.2 R |

OTHER PUBLICATIONS

*The Airplane and Its Engine,* Chatfield, Taylor and Ober, Fifth Ed. McGraw Hill, New York 1949, pp. 203–209.

*Primary Examiner*—Roy Lake
*Assistant Examiner*—Paul A. Bell

[57] ABSTRACT

An apparatus is provided for effecting automatic adjustments of the rotational position of a slotting head of a conventional container blank slotting machine, as required to accommodate the machine to handle container blanks of a length in excess of the maximum length of blank for which the machine was originally designed.

11 Claims, 11 Drawing Figures

AUTOMATIC COMPENSATING REGISTER

BACKGROUND OF THE INVENTION

In the slotting of paper board container blanks, it is conventional to employ a slotting mechanism comprising a pair of parallel rotatable shafts on which are mounted lengthwise spaced pairs of cooperating upper and lower slotting heads between which container blanks are fed. The upper slotting head of each pair is normally provided with two radially extending slotting blades, whereas the lower head of each pair is normally formed with a peripheral groove which receives the cutting edges of the blades. During proper operation of the machine, the blades of each slotting head are successively brought into engagement with each blank such that one of the blades cuts a slot in the leading edge and the other of the blades cuts an equal length slot in the trailing edge of such blank, whereby to define flaps which are later folded over to form the top and bottom walls of the container.

When the size of the blank is varied, it is conventional to alter the angular relationship between the blades of the slotting heads in order to obtain a desired spacing between slots. The changing of the angular relationship between blades may be accomplished manually or automatically by use of apparatus of the type disclosed for instance in U.S. Pat. Nos. 3,067,643 and 3,952,637.

It is also common practice to provide machines of the type under consideration with registering apparatus by which the rotatable position of the slotting heads may be changed relative to a main drive gear or similar mechanism of the machine, as required to insure equal length slots being formed in the forward and trailing edges of a given size container. Adjustments may be accomplished manually or automatically as disclosed for instance in U.S. Pat. No. 2,121,105 in addition to the patents mentioned above.

It has also been proposed in a paper board web severing equipment, as evidenced by U.S. Pat. No. 3,742,798 to selectively retard the rotational speed of a cutoff head for the purpose of varying the length of material severed from a continuous web, during each rotational cycle of the cutoff head.

SUMMARY OF THE INVENTION

The present invention is directed towards an automatic compensating register adapted for use in accommodating a slotting machine to handle container blanks of varying lengths. More particularly, the present invention has particular utility in the modification of standard slotting machines in order to permit same to accommodate container blanks of a length in excess of that for which they were originally designed to accommodate by means of adjustments of the angular relationship of blades of their slotting heads.

In accordance with the present invention, a register mechanism is mounted for rotation with a main drive gear of a slotting machine and operable in response to the sensed length of a container blank to effect both rearwardly and forwardly directed rotations of the slotting heads relative to the main drive gear, so as to effect slotting of front and rear edges of such container blank, which may be of a length exceeding the length of blank for which the machine was to be designed, and to then place the slotting heads in proper angular orientation relative to the main drive gear, as required to effect slotting of the front edge of a subsequently feed blank during a subsequent operational cycle of the main drive gear.

In a preferred form of the invention, the normally adjustable slotting blade of each slotting head is removed and the fixed slotting blade employed to effect slotting of both the front and rear edges of the container blanks.

The term "length", as used herein, will be understood as referring to the dimension of a carton measured in the direction in which the carton is fed through the machine.

DRAWINGS

The nature and mode of operation of the present invention will now be more fully described in the following detailed description taken with the accompanying drawings wherein.

Figure 6:
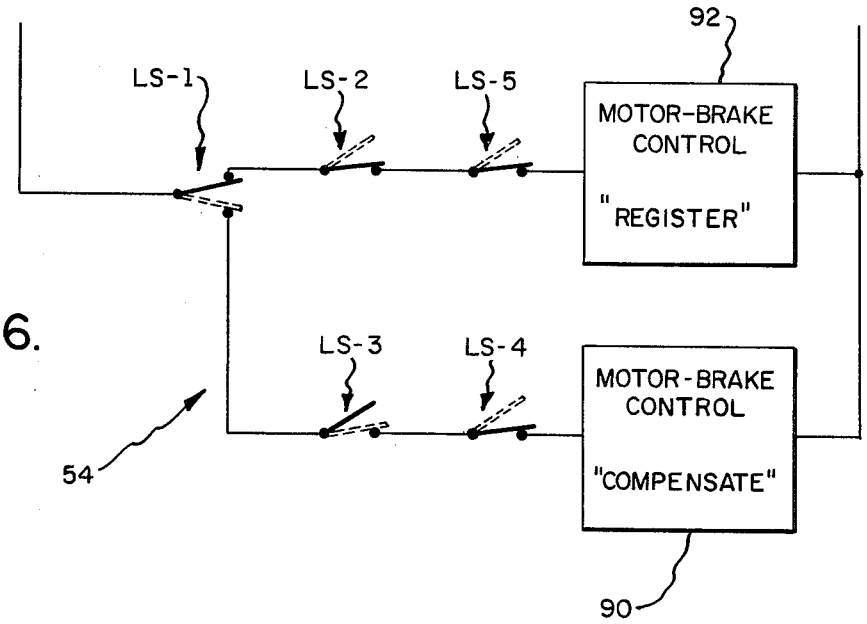

FIGS. 5*a*–5*f* are views illustrating successive portions of the operational cycle of a slotting head; and FIG. 6 is a view illustrating electrical control circuit employed in the practice of the present invention.

DETAILED DESCRIPTION

Figure 1:
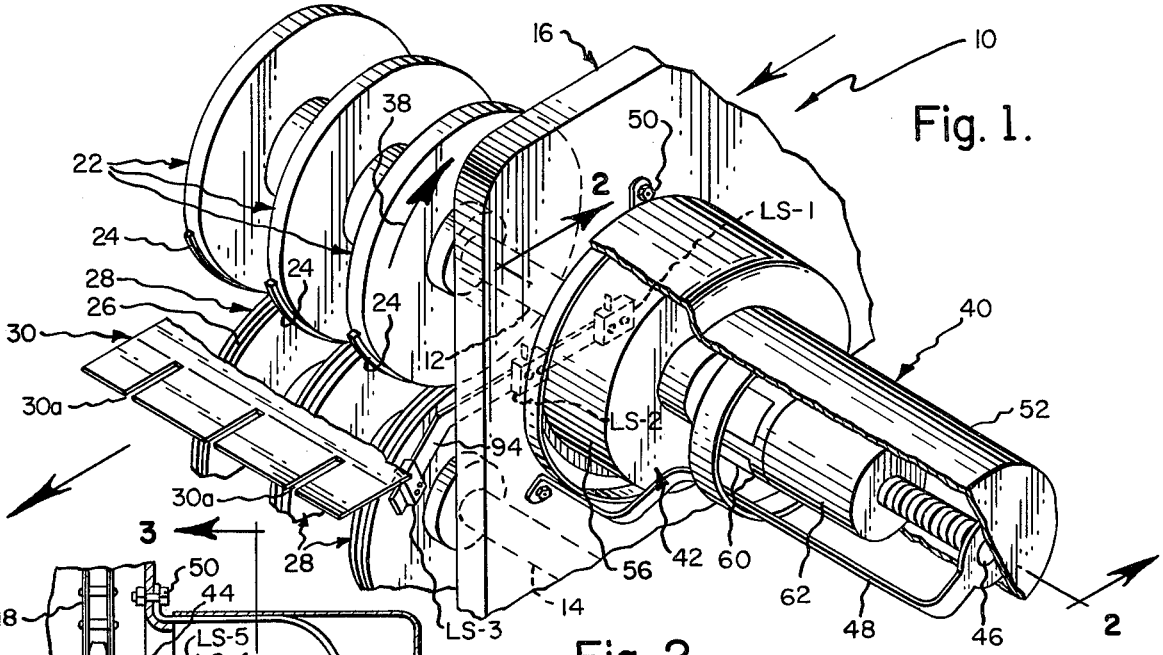
FIG. 1 is a fragmentary perspective view illustrating the register mechanism of the present invention installed in an otherwise conventional container blank slotting machine.
Figure 2:
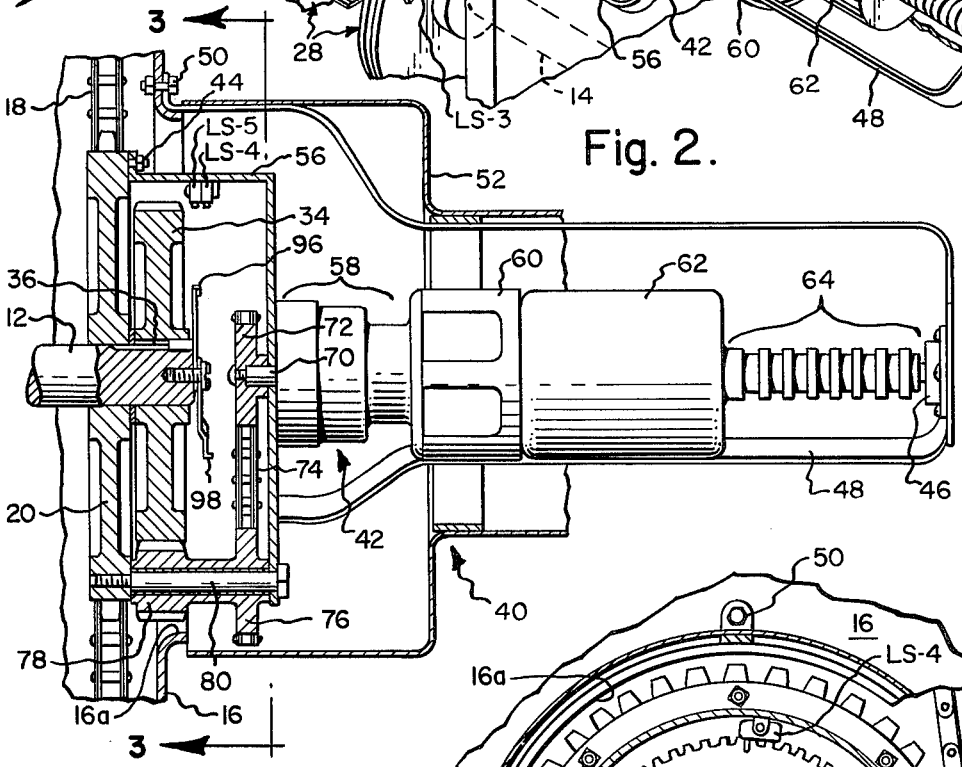
FIG. 2 is a sectional view taken generally along the line 2—2 in FIG. 1.
Figure 4:
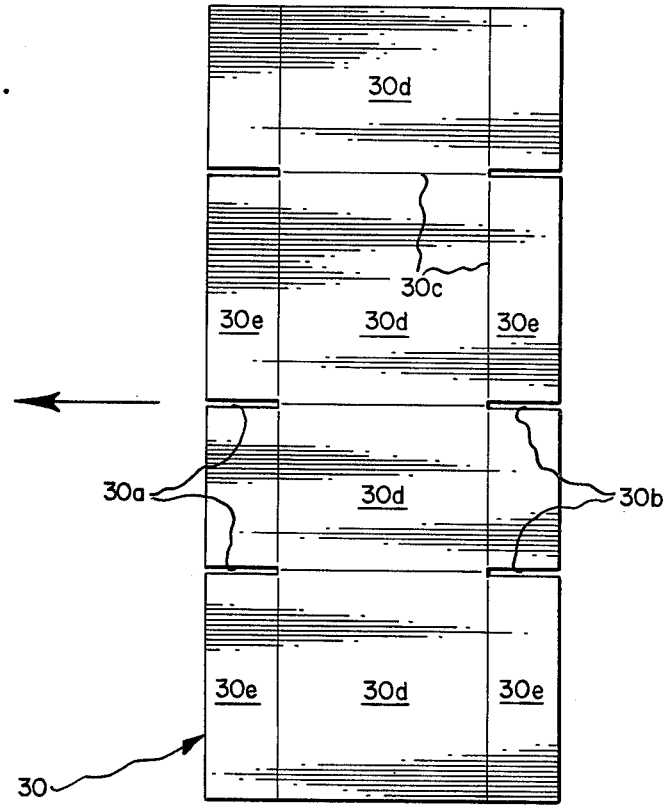
FIG. 4 is a plan view of a container blank having its leading and trailing edges slotted to define container top and bottom forming panels.

Reference is now made generally to FIGS. 1 and 2 wherein a conventional container blank slotting, scoring and printing machine is generally designated as 10 and is shown as including in part a pair of parallel and vertically aligned slotting shafts 12 and 14, which have their ends suitably journaled by machine side frames only one of which is designated at 16, and powered by a common drive including for instance a drive chain 18 trained about main drive gears, only one of which is designated at 20. Upper slotting shaft 12 conventionally mounts three slotting heads 22, which carry one or more slotting blades 24 adapted to be received within angular grooves 26 of associated lower slotting heads 28 carried by lower slotting shaft 14 for creating leading and trailing edge slots 30*a* and 30*b* in a paper or corrugated board container blank 30, as the latter is passed between the upper and lower slotting heads. It will be understood that machine 10 would additionally include a suitable container blank feed or transport assembly, designated generally as 32 in FIGS. 5*a*, 5*b* and 5*f*, which is operable to feed blanks one at a time and in a relatively spaced relationship such that slots are formed in the leading and trailing edges of such blank during each operational cycle of main drive gear 20. Also, non-illustrated portions of machine 10 would normally be operable to additionally form score line 30*c* in the blank, such that a finished blank shown for instance in FIG. 4 would include container side wall forming panels 30*d* and container top and bottom forming flaps 30*e*.

In conventional machines of the type depicted generally in FIG. 1, it is desirable to permit simultaneous adjustments of upper slotting heads 22 relative to their associated main drive gear 20 in order to insure that slots 30*a* and 30*b* be formed of equal length, and for this purpose the main drive gear is journaled on upper shaft 12 and adjustably rigidly fixed to an indexing gear 34 normally keyed, as at 36, for rotation with upper shaft 12. In the case of the conventional machine on which the subject invention was mounted for purposes of evaluation and trail, locking means in the form of threaded bolt devices, not shown, were originally employed to releasably clamp the indexing gear for rotation with the main drive gear in the direction indicated by arrows 38 in FIGS. 1 and 3. Conventionally, the frame of the machine is provided with an opening 16*a* for affording access to gears 20 and 34 and the above mentioned threaded bolt devices.

Reference is now made particularly to FIGS. 1 and 2, in which the registering mechanism of the present invention is generally designated at 40 and shown as including a drive assembly 42 having its inner end fixed as by bolts 44 for rotation with main drive gear 20 and its outer end journaled in a bearing 46 carried by a stationary bracket 48, which is in turn non-rotatably fixed to machine side frame 16, as by bolts 50, and enclosed within a safety shield or housing 52, and a control circuit designated generally as 54 in FIG. 6.

More specifically, drive assembly 42 includes a main drive gear affixed housing 56, a gear reduction and spacer unit 58, an electro-magnetically operated brake 60, an electric motor 62 and power supply collector ring-bearing assembly 64. The gear reduction unit, brake and motor are of conventional construction and have their casings suitably interconnected to one another and to the housing 56 for conjunctive rotary movements. The output from gear reduction unit 58 is shown in FIG. 2 as being in the form of a drive shaft 70 to which a sprocket 72 is keyed for rotation. Sprocket 72 is drivingly connected by a chain belt 74 to a sprocket 76, which is formed integrally with a gear 78 arranged to mesh with index gear 34. Sprocket 76 and gear 78 are journaled on a shaft 80, whose opposite ends are carried by the main drive gear 20 and housing 56. It will be understood from the foregoing that when rotation of drive shaft 70 relative to housing 56 is arrested, as by deenergizing motor 62 and energizing brake 60, index gear 34 is locked or fixed for rotation with main drive gear 20 such that slotting heads 22 are driven at some given rotational speed determined by the design of machine 10. However, counterclockwise or compensating and clockwise or registering rotations of index gear 34 relative to main drive gear 20, as viewed in FIG. 3, may be effected by deenergized brake 60 and energizing motor 62 to operate in forward and reverse directions, as indicated by arrows 84*a* and 84*b*, respectively.

The present invention contemplates momentarily retarding or reversing rotation of index gear 34 relative to main drive gear 20 after formation of leading edge slots 30*a* in a container blank 30 for a period of time sufficient to permit such blank to be transported into a position allowing blades 24 to effect forming of trailing edge slots 30*b*. After formation of the trailing edge slots, the present registering mechanism serves to drive the index gear at a faster rate than the main drive gear for a period of time sufficient to register the blades for proper engagement with the leading edge of a following container blank fed by the machine. Relative rotations of index gear 34 in regard to main drive gear 20 is controlled by previously mentioned control circuit, which comprises five limit switches LS-1 through LS-5; and motor-brake control systems 90 and 92. Limit switches LS-1, LS-2, LS-4 and LS-5 normally reside in their circuit conditions shown in full line in FIG. 6. Motor-brake control systems include circuits, which deenergize brake 60 when motor 62 is energized to operate in forward and reverse directions, respectively.

Figure 3:
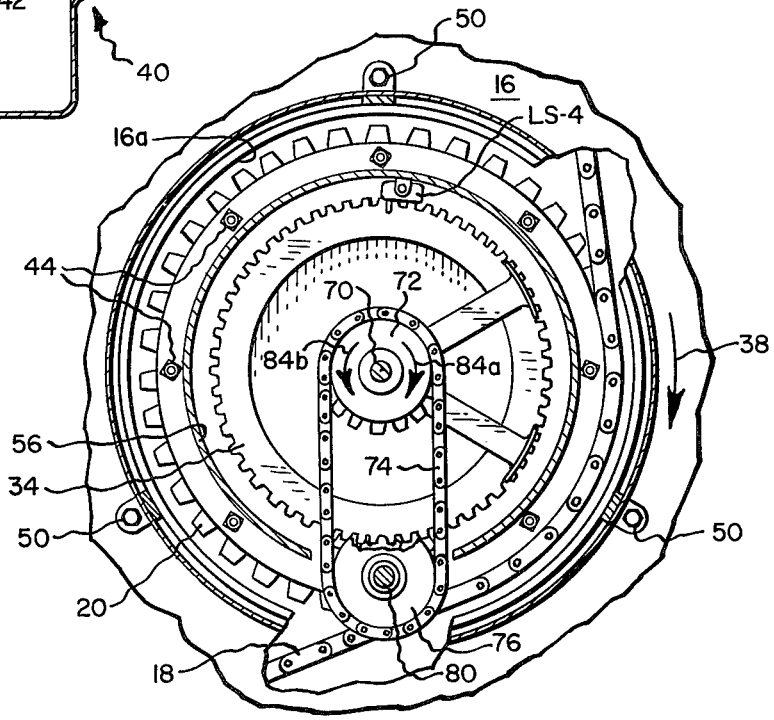
FIG. 3 is a sectional view taken generally along the line 3—3 in FIG. 2.

By referring to FIGS. 1 and 5*a*–5*f*, it will be understood that switches LS-1, LS-2 and LS-3 are supported on a bracket 94 and arranged for sensing the positioning of a container blank 30, as the latter is fed through the machine between slotting heads 22 and 28, whereas by referring to FIGS. 2 and 3 it will be understood that switches LS-4 and LS-5 are fixed to housing 56 and arranged for engagement by radially extending cam operators 96 and 98, respectively, which are adjustably fixed for rotation with shaft 12.

Figure 5A:
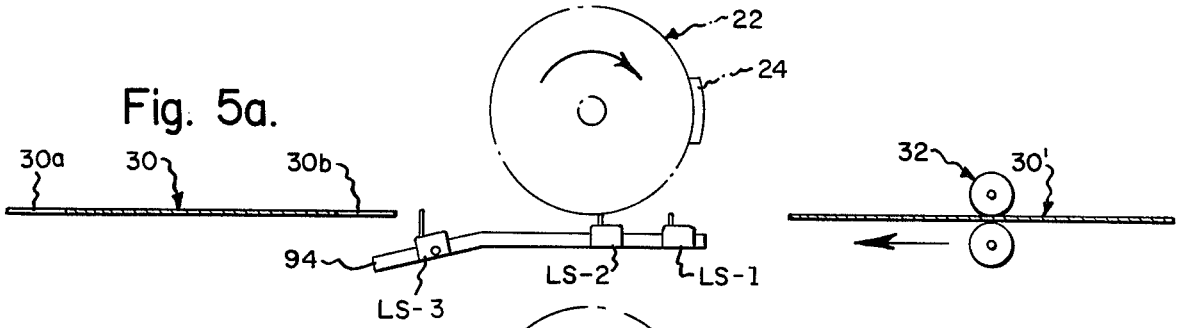
Figure 5B:
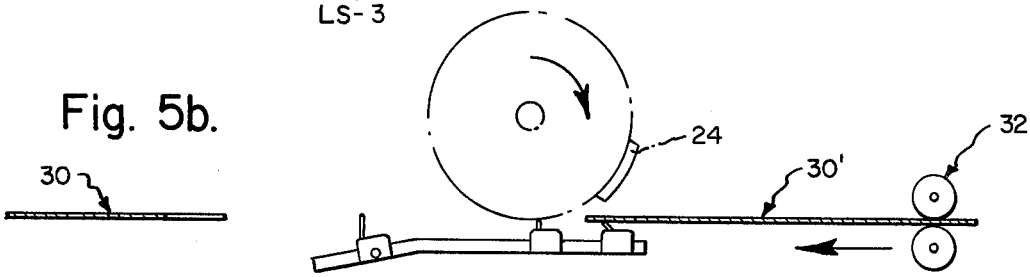

Operation of a slotting machine 10 equipped with registering mechanism 40 will now be described with particular reference to FIGS. 3, 6 and 5*a*–5*f*. In this connection, FIG. 5*a* illustrates the initiation of a cycle of machine operation, wherein a non-slotted container blank 30' is being fed towards slotting heads 22 and the slotting heads are locked for rotation with main drive gear 20. At this point in the operational cycle, brake 60 is energized; motor 62 is deenergized; switches LS-1 through LS-5 assume their conditions shown in FIG. 6; and cam operators 96 and 98 are angularly spaced from operating engagement with switches LS-4 and LS-5, as generally indicated in FIG. 3. In FIG. 5*b*, blank 30' is shown as having been fed into engagement with switch LS-1, which results in switch LS-1 being operated or switched to assume its broken line condition shown in FIG. 6.

Figure 5C:
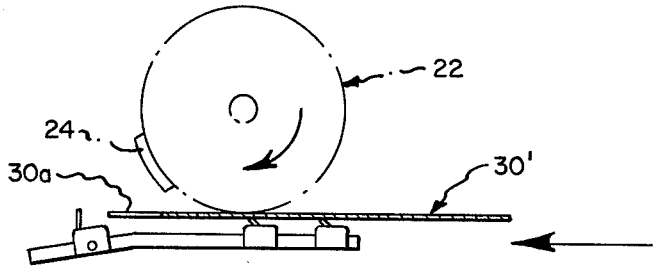

In FIG. 5*c*, blank 30' is shown as having been fed into operative engagement with switch LS-2, which results in such switch being operated or switched to assume its broken line or open condition shown in FIG. 6, and as having slots 30*a* formed in its leading edge.

Figure 5D:
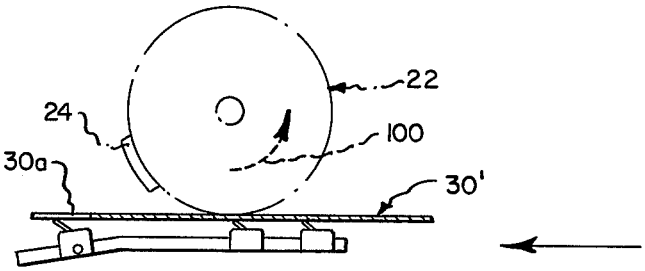
Figure 5E:
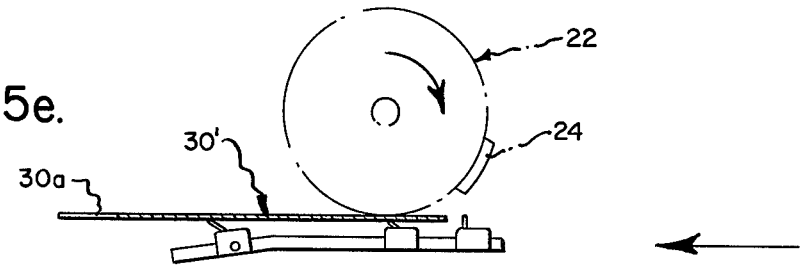
Figure 5F:
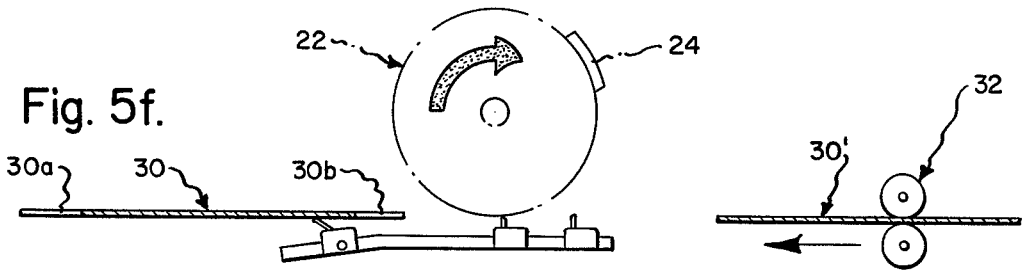

In FIG. 5*d*, blank 30' is shown as having been fed into operative engagement with switch LS-3, which results in such switch being operated or switched to assume its broken line or closed condition shown in FIG. 6. With the closing of switch LS-3, there is established a circuit through control system 90, which serves to deenergize brake 60 and energize motor 62 to effect rotation of drive shaft 70 in a forward direction indicated by arrow 84*a* in FIG. 3. This results in index gear 34 and thus slotting heads 22 being momentarily retarded or driven in an opposite direction relative to main drive gear 20, as indicated by broken arrow 100 in FIG. 5*d*. Relative or compensating rotation of the index gear continues until cam operator 98 engages with switch LS-4, which results in such switch being operated or switched into its broken line or open condition shown in FIG. 6, whereupon the circuit through control system 90 is interrupted. Upon interruption of the circuit through control system 90, brake 60 is energized and motor 62 is deenergized, such that index gear 34 is again locked for rotation with main drive gear 20, as indicated in FIG. 5*e*. As will be appreciated, cam operator 98 would be adjusted relative to shaft 12 in order to vary the angle through which it is driven prior to operation of switch LS-4, as required to position blades 24 angularly relative to the main drive gear to permit trailing edge slots 30*b* to be properly formed.

During continued movement of blank 30', the blank is in succession removed from operating engagement with switch LS-1, whereby permitting such switch to return to its original position; engaged by blades 24 to form slots 30*b*; and then removed from engagement with switch LS-2, whereby permitting such switch to return to its original or closed position. Upon closing of switch LS-2, a circuit is established through control system 92, which serves to deenergize brake 60 and energize motor 62 to effect rotation of drive shaft 70 in a reverse direction as indicated by arrow 84*b* in FIG. 3. This results in index gear 34 and thus slotting heads 22 being driven at a faster rate than main drive gear 20, as indicated by arrow 102 in FIG. 5*f*. Relative or registering rotation of the index gear continues until cam operator 96 engages with switch LS-5, which results in such switch being operated or switched into its broken line or upon condition shown in FIG. 6, whereupon the circuit through control system 92 is interrupted. Upon interruption of the circuit through control system 92, brake 60 is energized and motor 62 deenergized, such that index gear 34 is again locked for rotation in registration with main drive gear 20 to complete an operational cycle of the apparatus. Cam operator 96 would be adjusted relative to shaft 12 in order to vary the angle through which it is driven prior to operation of switch LS-5, as required to register blades 24 angularly relative to the main drive gear to permit leading edge slots 30*a* to be properly formed in a subsequently fed blank, which is indicated at 30″ in FIG. 5*f*.

It will be understood that in the illustrated construction, the utilization of a single fixed slotting blade requires main drive gear 20 to be driven through two complete rotations during each operational or single blank slotting cycle of the machine. If two slotting blades were to be employed on each of the slotting heads, it would be only necessary to drive the main drive gear through one complete rotation during each operational cycle. Further, while the illustrated control circuit is preferred from the standpoint of simplicity and low cost construction, it will be appreciated that the microswitch operated circuit could be replaced by control circuits variably programmed to effect timed operation of the motor and brake in accordance with variations in length of the container blanks to be slotted.

Machine 10 may be re-converted to handle sizes of container blanks for which it was originally designed by simply disconnecting the power supply for control circuit 54 and re-mounting conventional adjustable slotting blades on the slotting heads, as required by blank sizes being processed.

I claim:

1. In a container blank slotting apparatus having slotting head means fixed for rotation with a shaft, means for transporting a container blank to be slotted at a given speed past said slotting head means, an index gear fixed for rotation with said shaft, a main drive gear and means for locking said index gear for rotation with said main drive gear, said main drive gear being driven at a rotational speed correlated with container blank transport speed to effect forming of slots in leading and trailing edges of said container blank by said slotting head means, the improvement in combination for accommodating said apparatus to handle container blanks of a length in excess of the maximum length for which said apparatus was designed, said improvement comprising:

a drive assembly supported on and for rotation with said main drive gear for selectively locking said index gear for rotation with and driving said index gear for oppositely directed rotations relative to said main drive gear during each blank slotting operational cycle of said apparatus, thereby in sequence to initially rotatably position said slotting head means relative to said main drive gear for slotting a leading edge of said container blank in its direction of travel, to reposition said slotting head means relative to said main drive gear for slotting a trailing edge of said container blank and to return said slotting head means to its initial rotatable position relative to said main drive gear, said drive assembly includes an electric motor, an electric brake and motion transmission means connecting the output of said motor and brake to means operable to selectively lock said index gear for rotation with and drive said index gear for rotation to said main drive gear; and control means for controlling operation of said drive assembly in response to feeding of said container blank relative to said slotting head means, said control means controls energization of said motor and said brake.

2. In a container blank slotting apparatus having slotting head means fixed for rotation with a shaft, means for transporting a container blank to be slotted at a given speed past said slotting head means, an index gear fixed for rotation with said shaft, a main drive gear and means for locking said index gear for rotation with said main drive gear, said main drive gear being driven at a rotational speed correlated with container blank transport speed to effect forming of slots in leading and trailing edges of said container blank by said slotting head means during each operational cycle of said apparatus, the improvement in combination for accommodating said apparatus to handle container blanks of a length in excess of the maximum length for which said apparatus was designed, said improvement comprising:

an electrically operated drive assembly supported on and for rotation with said main drive gear for selectively locking said index gear for rotation with and driving said index gear for oppositely directed rotations relative to said main drive gear; and circuit means responsive to feeding of said container blank relative to said slotting head means for controlling operation of said drive assembly during each said operational cycle of said apparatus to initially rotatably position said slotting head means relative to said main drive gear for slotting a leading edge of said container blank in its direction of travel, to reposition said slotting head means relative to said main drive gear for slotting a trailing edge of said container blank and to return said slotting head means to its initial rotatable position relative to said main drive gear.

3. An improvement according to claim 2, wherein said drive assembly includes gear means for coupling said index gear to said main drive gear, and electrically operated means for selectively locking said gear means against rotation relative to said main drive gear whereby to lock said index gear for rotation with said main drive gear and for effecting opposite rotational movements of said gear means relative to said main drive gear whereby to drive said index gear for oppositely directed rotations relative to said main drive gear during each said operational cycle of said apparatus.

4. An improvement according to claim 3, wherein said drive assembly includes an electric motor, an electric brake and motion transmitting means connecting an output from said motor and brake to said gear means, and said circuit means is operable to energize said brake while deenergizing said motor to lock said gear means against rotation relative to said main drive gear and to deenergize said brake while energizing said motor for selectively driving said gear means for rotation in opposite directions relative to said main drive gear.

5. An improvement according to claim 4, wherein said circuit means includes means for sensing the position of said container blank relative to said slotting head means and means for sensing the rotatable position of said slotting head means relative to said main drive gear.

6. In a container blank slotting apparatus having slotting head means fixed for rotation with a shaft, means for transporting a container blank to be slotted at a given speed past said slotting head means, an index gear fixed for rotation with said shaft, a main drive gear and means for locking said index gear for rotation with said main drive gear, said main drive gear being driven at a rotational speed correlated with container blank transport speed to effect forming of slots in leading and trailing edges of said container blank by said slotting head means, the improvement in combination for accommodating said apparatus to handle container blanks of a length in excess of the maximum length for which said apparatus was designed, said improvement comprising:

a drive assembly supported on and for rotation with said main drive gear for selectively locking said index gear for rotation with and driving said index gear for oppositely directed rotations relative to said main drive gear during each blank slotting operational cycle of said apparatus, thereby in sequence to initially rotatably position said slotting head means relative to said main drive gear for slotting a leading edge of said container blank in its direction of travel, to reposition said slotting head means relative to said main drive gear for slotting a trailing edge of said container blank and to return said slotting head means to its initial rotatable position relative to said main drive gear, said drive assembly includes a housing fixed for rotation with said main drive gear, gear means meshing with said index gear and journaled adjacent opposite ends thereof on said main drive gear and housing, an electric motor and an electric brake mounted on said housing, and motion transmission means connecting an output of said motor and said brake to said gear means; and control means for controlling operation of said drive assembly in response to feeding of said container blank relative to said slotting head means, said control means being operable to alternatively energize and deenergize said motor and said brake, said brake when energized locking said gear means against rotation to lock said index gear for rotation with said main drive gear and said motor when energized rotating said gear means to effect rotation of said index gear relative to said main drive gear.

7. An improvement according to claim 6, wherein said control means includes switch means responsive to positioning of leading and trailing edges of said container blank relative to said slotting head means and additional switch means responsive to rotational displacements of said index gear relative to said main drive gear, said switch means and additional switch means being arranged in a circuit alternatively energizing and deenergizing said motor and said brake.

8. An improvement according to claim 7, wherein first and second cam means are fixed to said index gear for rotation therewith and to permit adjustment of the spacing therebetween in a direction extending annularly to said index gear, and said additional switch means are carried by said housing and arranged for engagement with said first and second cam means incident to slotting head means repositioning and return rotations of said index gear relative to said main drive gear.

9. In a container blank slotting apparatus having a frame, a shaft rotatably supported by said frame, slotting head means fixed for rotation with said shaft, means for transporting a container blank to be slotted at a given speed past said slotting head means, an index gear fixed for rotation with said shaft, a main drive gear journaled on said shaft adjacent said index gear and locking means for locking said index gear for rotation with said main drive gear, said main drive gear being driven at a rotational speed correlated with container blank transport speed to effect forming of slots in leading and trailing edges of said container blank by said slotting head means during each operational cycle of said apparatus, said frame having an opening for affording access to said index gear, said main drive gear and said locking means, the improvement in combination for accommodating said apparatus to handle container blanks of a length in excess of the maximum length for which said apparatus was designed, said improvement comprising:

said locking means is a drive assembly supported for rotation with said main drive gear for selectively locking said index gear for rotation with and driving said index gear for oppositely directed rotations relative to said main drive gear during each said operational cycle, said drive assembly including a housing fixed to said main drive gear for rotation therewith, said housing extending axially thereof outwardly through said opening, gear means meshing with said index gear and journaled adjacent opposite ends thereof on said main drive gear and said housing, drive means mounted on said housing and means for coupling said drive means with said gear means;

a safety shield fixed to said frame peripherally of said opening and enclosing said drive assembly; and control means for controlling operation of said drive means in sequence during each said operational cycle to initially rotatably position said slotting head means relative to said main drive gear for slotting a leading edge of said container blank in its direction of travel, to reposition said slotting head means relative to said main drive gear for slotting a trailing edge of said container blank and to return said slotting head means to its initial rotatable position relative to said main drive gear.

10. An improvement according to claim 9, wherein said slotting head means includes a slotting head fixed to said shaft and a single slotting blade fixed to said slotting head.

11. An improvement according to claim 10, wherein said control means includes means for sensing the position of said container blank relative to said slotting head and means for sensing the rotatable position of said slotting blade relative to said main drive gear.

* * * * *